US005803248A

United States Patent [19]

Cox

[11] Patent Number: 5,803,248

[45] Date of Patent: Sep. 8, 1998

[54] VAPOR/MOISTURE PROOF BLISTER PACK

[76] Inventor: Nicholas Cox, South Route Box 12, Lavina, Mont. 59046

[21] Appl. No.: 937,091

[22] Filed: Sep. 24, 1997

[51] Int. Cl.[6] ..... B65D 75/00

[52] U.S. Cl. ..... 206/213.1; 206/467

[58] Field of Search ..... 206/205, 213.1, 206/461, 467, 468, 469, 470, 471, 524.1, 524.8

[56] References Cited

U.S. PATENT DOCUMENTS

| | | | |
|---|---|---|---|
| 3,481,101 | 12/1969 | Steadman | 53/22 |
| 3,954,173 | 5/1976 | Eaton | 206/205 |
| 4,014,433 | 3/1977 | Cerwin | 206/63.3 |
| 4,062,449 | 12/1977 | Popkes et al. | 206/471 |
| 4,069,348 | 1/1978 | Bush | 426/119 |
| 4,180,165 | 12/1979 | Kuchenbecker | 206/461 |
| 4,278,693 | 7/1981 | Dingethal et al. | 426/129 |
| 4,379,514 | 4/1983 | Joffe | 221/279 |
| 4,795,029 | 1/1989 | Campbell et al. | 206/278 |
| 4,807,747 | 2/1989 | Hadtke | 206/327 |
| 4,815,602 | 3/1989 | Schirmer | 206/497 |
| 4,988,302 | 1/1991 | Smith et al. | 435/298 |
| 5,064,056 | 11/1991 | Gresh | 206/45.19 |
| 5,074,416 | 12/1991 | Hustad | 206/524.8 |
| 5,176,258 | 1/1993 | Antal | 206/461 |
| 5,307,934 | 5/1994 | Hagner | 206/471 |
| 5,353,935 | 10/1994 | Yeager et al. | 206/470 |
| 5,398,908 | 3/1995 | Kienle | 206/471 |
| 5,413,217 | 5/1995 | Sauer | 206/363 |
| 5,456,382 | 10/1995 | Gringer | 221/252 |
| 5,486,390 | 1/1996 | Burns et al. | 206/467 |
| 5,522,505 | 6/1996 | Giovannone | 206/462 |

*Primary Examiner*—Jacob K. Ackun
*Attorney, Agent, or Firm*—Ken J. Pedersen; Barbara S. Pedersen

[57] ABSTRACT

Various embodiments of a plastic blister system are shown and described. The blister system is comprised of a blister to which a lid or backing of the same material may be tightly fitted and sealed by virtue of one or more cooperating "steps" near the outer perimeters of the blister and or lid, and by virtue of the outer perimeters of the blister and lid being continuously sealed to the cardboard or other planar sheet of backing. When the blister pack is thus sealed and attached to the cardboard, any odors or vapors which may possibly emit from the product, which is encased within the sealed blister, are also totally sealed in and cannot escape. Also, the sealed blister prevents outside moisture and gasses from contacting the product until the blister is opened. The degree of tightness of fit of the seal may be varied by the design and number of steps by which the blister and lid are formed together, but in any case, the degree of tightness of fit is not affected by the shape of the blister, which can be shaped to accommodate any size or shape of product.

12 Claims, 4 Drawing Sheets

VAPOR/MOISTURE PROOF BLISTER PACK

BACKGROUND OF THE INVENTION

1. Field of the Invention.

This invention relates to the process of sealing a product to be marketed in a plastic blister mounted on a card. More specifically, this invention relates to totally encompassing the product within a plastic bubble or blister comprised of two plastic pieces which meet near their peripheries, to seal the product enclosed within, before the blister is attached to the blister card, thus ensuring that no odors or vapors will escape from the product and that no moisture will come into the blister prior to opening the blister.

2. Related Art.

It is commonplace to find products displayed at a store, or shipped to a destination, encased in a plastic bubble, or blister. Said blister is generally designed to cover the product, and, if the product has delicate parts, to prevent the product from moving about within the blister. Said blister is sealed in some manner to a card, the means being various, but all designed so the blister does not separate from its card until the need for using the product arises. The typical blister is shaped and attached so that the product rests on the card and the outer edge of the blister is attached to the card. In the case of merchandising, the cards can be hung on a hook or laid upon a counter and the prospective buyer can see exactly what the product looks like. The risk to the seller of the merchandise soiling or breaking is far less than if the product were not thus packaged.

Over time, various disclosures of embellishments upon the plain blister have been made. U.S. Pat. No. 4,180,165 (Kuchenbecker, Apr. 20,1978) disclosed an embodiment of blister packaging involving an insert with an opening at the bottom and a bearing surface on the insert for sliding into the main packaging. The main packaging comprises a carton having interconnected panels to support the insert and provide inward-locking tabs to hold the bearing surface in place.

The disclosure of a shipper package in U.S. Pat. No. 4,278,693 (Dingethal and Bartosek, Apr. 21,1980) provides for a rigid base with upending ridge portions for defining a target area for a meat product. Ultimately, when the height of the enclosed material is determined, said meat material and the rigid base are covered with a vacuum-sealed wrapper sheet.

Antal (U.S. Pat. No. 5,176,258) discloses a method whereby a product packaging is comprised of a recessed body to hold said product, a foam insert to hold the product in position and a cover to completely cover the recess. The foam insert has flanges which are compressed between the cover and the recessed body. A seal joins the cover to the body around the recess and to the flanges in such a manner that the foam inserts stay with the cover when the cover is removed from the body.

Sauer (U.S. Pat. No. 5,413,217) discloses a double packaging arrangement which is held together by virtue of a flange surrounding a cavity in the product-encompassing blister, to which an adhesive lid is sealed. The outer packaging has walls parallel to and somewhat larger than the walls of the inner blister and receives the blister so that it is held in place by the flange. The outer packaging forms a well through which the blister and product can be seen.

Other patents disclose various packaging approaches, such as Gringer (U.S. Pat. No. 5,456,382), which has a hinged door that pivots out from the package to reveal the product. Gresh (U.S. Pat. No. 5,064,056) and Hadtke (U.S. Pat. No. 4,807,747) discloses plastic box-like packages. Bush (U.S. Pat. No. 4,069,348) discloses packaging with a plurality of compartments for enclosing several food slices between interleaf sheets.

Therefore, upon the search of the above-cited patents, the inventor and those in privity with him are not aware that any other prior efforts anticipate the claims made herein. What is still needed is a method by which a product is totally encompassed and sealed into a plastic blister that surrounds the product on every side before said blister is securely attached to a blister card. Then there is no risk that odors or vapors could escape, particularly through, but not confined to, the pores of the card.

SUMMARY OF THE INVENTION

This invention is a plastic blister comprised of two parts. A top member (hereafter, also called a "blister") may be a bubble, dome, or other shape needed to accommodate the product to be sealed and has a bottom outer perimeter that has a flat flange that ultimately is adhered to the cardboard backing. A bottom member (also called a "lid") fits tightly into a ridge or several ridges, herein called "steps", at the bottom outer perimeter of the top member, inside the flat flange of the top member. The top member and bottom member thus fit tightly together to create a seal by means of the mechanical communication of their surfaces in the area of the step(s). The top and bottom member's are slightly flexible and there is a slight interference between the top and bottom member's stepped surfaces to create a friction fit between the surfaces, which allows the bottom member to "snap" into the top member. Optionally, the bottom member steps or flange may additionally be adhesively or otherwise sealed to the top member steps or flange, for additional sealing.

This snug fit of the top and bottom member steps, and the attachment by adhesive or other means of the outer perimeters of the top member and bottom member to a cardboard backing board, renders the product tightly encased on all sides by plastic blister material. A product thus encased may be displayed and described by indicia on the backing card, as with other product packs, but, in addition, the product is totally sealed in the plastic blister and no odors or vapors escape into the air, no moisture from the product dampens the cardboard, and no moisture or humidity from the outside atmosphere harms the product inside the blister. The invented simple, economical system of two plastic members, a sheet of cardboard and adhesive may achieve this benefit without requiring additional apparatus, wrapping means, or packaging. In cases where additional adhesive or tape or other sealing means attaches the top member to the bottom member, even should the blister become detached from the blister backing, the product typically may remain totally enveloped in the sealed-together components of the preferred embodiment until the blister is purposely taken apart.

DESCRIPTION OF THE PREFERRED EMBODIMENTS

Referring to the Figures, there are shown several, but not the only, embodiments of the invented blister pack system. The system features a simple, economical approach to vapor-proof packaging on a moisture- or vapor-permeable backing such as cardboard. Various products may benefit by such a system of packaging, for example, herbal products, natural products without preservatives, medical supplies, bandages, food products, pet products, scented products, etc.

Figure 1:
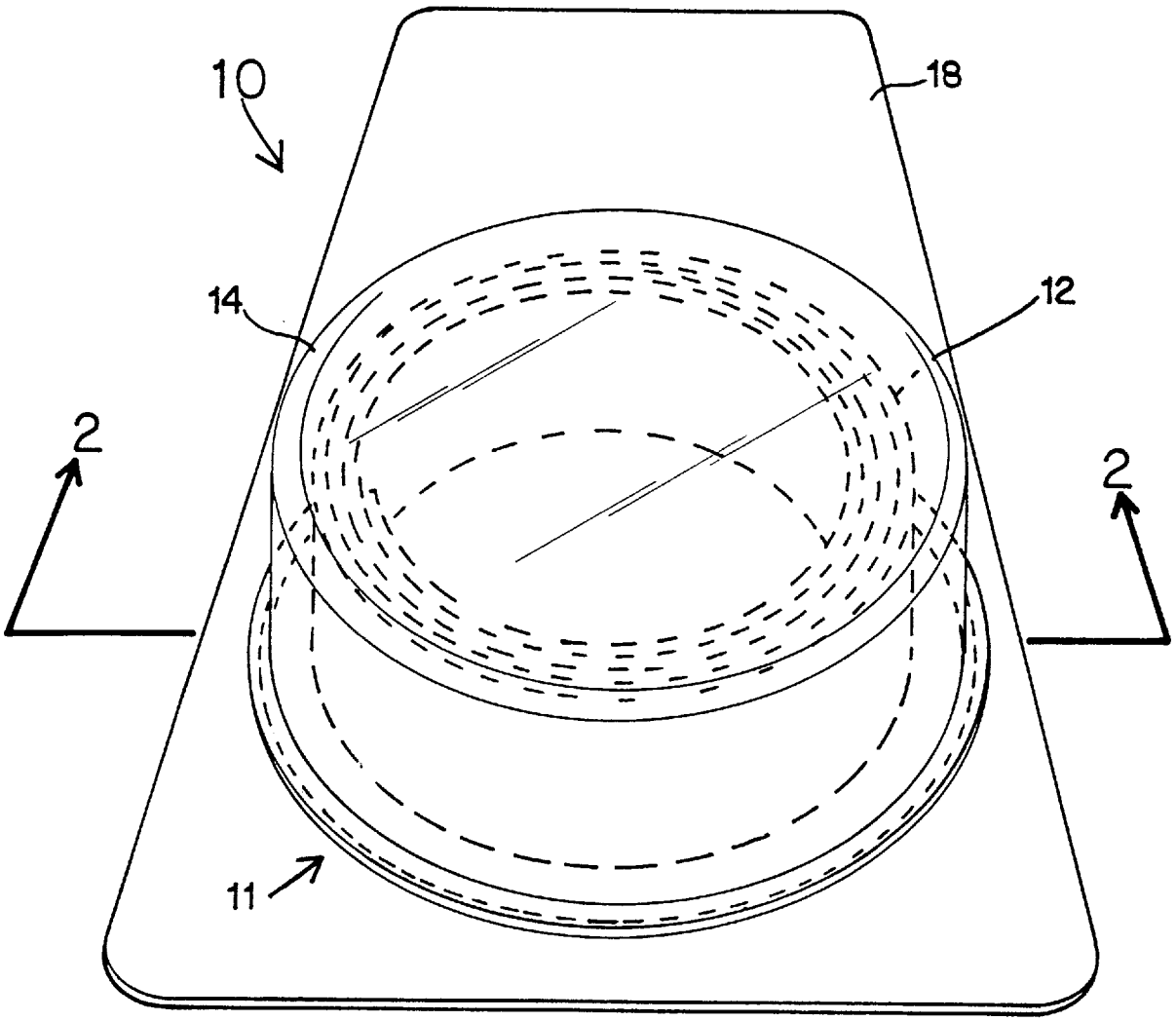
FIG. 1 is a perspective view of one embodiment of the invented packaging system.
Figure 2:
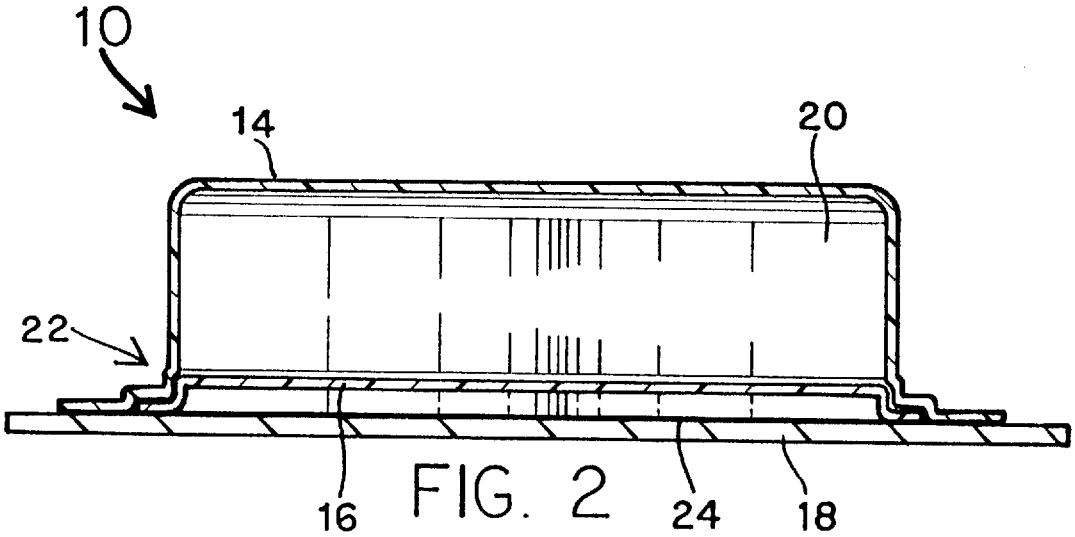
FIG. 2 is a cross-sectional side view of the embodiment of FIG. 1, viewed along the lines 2—2 in FIG. 1.

FIG. 1 shows the one embodiment of the packaging system 10 enclosing, for example, an herbally-treated product 12. As shown in the cross-sectional view of FIG. 2, the preferred system 10 comprises a top member 14 and a bottom member 16 that cooperate to form a blister pack 11, and cardboard back 18. Both the top and bottom members 14, 16 are preferably moisture- and air-impermeable, clear plastic such as P.E.T., preferably, but not necessarily, formed by thermal forming methods. Top member 14 is usually generally dome-shaped with an open bottom, and in FIGS. 1 and 2 is shown as generally circular, but may be other shapes to accommodate various products. Bottom member 16 is shown in FIG. 2 to be a generally circular lid-shape to match the circular top member 14, but may be other shapes to accommodate various top members and various products. The bottom member 16 typically is wider in diameter than the opening of the upper member but has an outer periphery that does not extend to the horizontal extent of the top member outer periphery.

The top member 14 and bottom member 16 meet near their peripheries in such a manner as to mate and seal against each other to hinder or prevent vapor or gasses from leaving or entering the interior space 20 that is formed between the top and bottom members to receive the product. In addition, at least the outer flange 30 of the top member, and, preferably, both the top member outer flange 30 and the outer flange 35 of the bottom member are attached to the cardboard back 18 in such a way that no vapor or gas may pass into or out of the interior space. The preferred method of attaching the flanges is to seal the flanges 30, 35, which are generally parallel and preferably co-planar, to the cardboard back with a thermal activated adhesive that coats preferably the entire card (the lid flange and the blister flange are then thermally activated to make the seal), but other adhesive and attachment means may be used. Thus, the thermal activated adhesive preferably extends continuously around the entire lower, outer perimeter of the blister pack (that is, preferably both the lid flange and the blister flange), but other adhesives or attachment means may be used. With the preferred system, there is a double-seal created by 1) the cooperating steps, and 2) the adhesive attaching the blister pack to the cardboard 18.

The extension of the cardboard backing beyond the blister and lid provides for ample surface for indicia and printed instruction and advertising on the backing, unobstructed by the blister, lid, and product.

As shown in FIGS. 3–6, several options are shown for sealing the blister (top member 14) to the lid (bottom member 16). These are not the only possibilities, but those set forth here are to demonstrate the general procedure. The preferred stepped surfaces include generally horizontal step surfaces and generally vertical risers, that is, the steps are preferably, although not necessarily exactly, 90 degree steps, with step and riser surfaces about 1/16–1/4 inches in length. The preferred sealing means 22 comprises two steps in the top member 14 for conforming to the upper surface of the bottom member 16. Each step preferably contacts its cooperating surface, leaving little or no space in between that might allow gas and moisture passage. The tightness of the desired seal can be enhanced by the number of cooperating steps on the top member 14 and the sealing bottom member flange 35.

Figure 3:
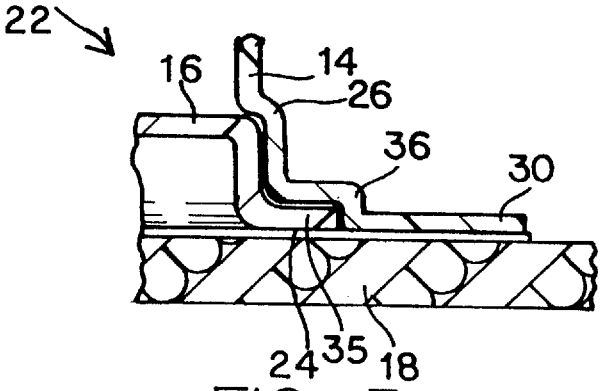
FIG. 3 is a side, cross-sectional detail view of the stepped sealing means of the embodiment of FIG. 1.

In the preferred sealing means 22, in FIG. 3, the lid has two bends 32 and 34 creating one step, having one riser surface 31 and one step surface 33, and flange 35, which fit snugly against the steps 26, 36 of the blister (14), to seal the members together. Thus, the lid and blister contact each other along two vertical riser surfaces and two horizontal surfaces. After the product is enclosed in the two-part blister pack 11, the blister pack 11 is then sealed onto the blister card 18.

Figure 4:
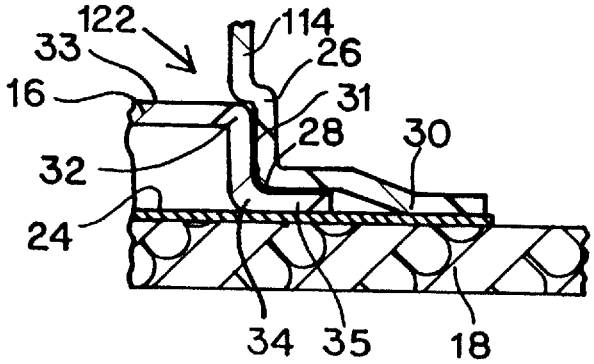
FIG. 4 is a side, cross-sectional detail view of another, alternative stepped sealing means of the invention.

In FIG. 4, an alternative sealing means 122 shows similarly how the one step of the lid (having one riser surface and one step surface) fits into the one step 26 of the blister (top member 114). In this embodiment, the top member flange 30 bends slightly down to be generally coplanar with the lid flange 35 and to contact the thermal adhesive 24 extending out from the bottom member flange 35.

Figure 5:
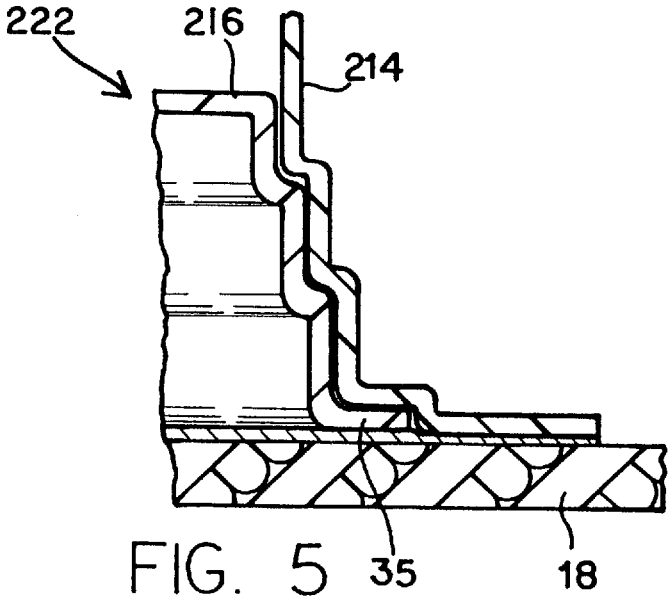
FIG. 5 is a side, cross-sectional detail view of another, alternative stepped sealing means of the invention.
Figure 6:
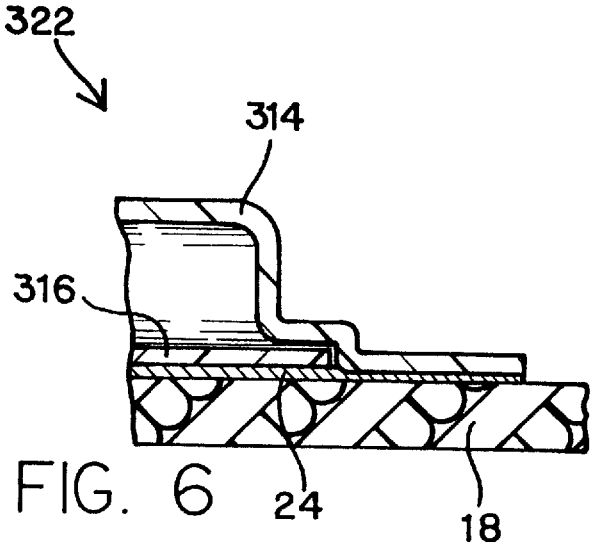
FIG. 6 is a side, cross-sectional detail view of another, alternative stepped sealing means of the invention.

A multi-step sealing means 222 is shown in FIG. 5, whereby the lid (216) has three steps (comprising three step surfaces and three risers surfaces) and flange 35. The top riser surface, two middle step surfaces, and the outer flange 35 of the lid's upper surface friction fit with the blister's (top member 214) corresponding steps and risers to create the seal.

With the preferred system, the product is fully surrounded, including a moisture and vapor barrier (the bottom member 16) between the moist, fragrant, aromatic, or sterile product and the gas and moisture-permeable cardboard 18. Because of the stepped lid, each of the embodiments in FIGS. 3–5 hold the product up off of the card 18 a distance equal to the space between the lid bottom surface near its central area and the card, plus the thickness of the lid, creating an air-space between the card and the lid. The alternative embodiment shown in FIG. 6 utilizes a generally flat lid (bottom member 316) that has no step other than the step formed by the vertical side surface and the horizontal top surface meeting at about 90 degrees at the lid's outer perimeter. This flat lid is sealed flat on the card 18, by means of the preferred thermal adhesive discussed above, with preferably no air space between the lid and the card. The blister (top member 314) cooperating with the lid of FIG. 6 has two steps, created by bends in the plastic to make the blister conform to the top surface and the vertical surface of the lid outer perimeter.

FIGS. 3–6 illustrate that the adhesive 24 preferably extends at least out to the horizontal extent of the blister flange 30. As discussed above, when the preferred thermal adhesive is used, it extends along substantially the entire upper surface of the backing card 18.

Figure 7:
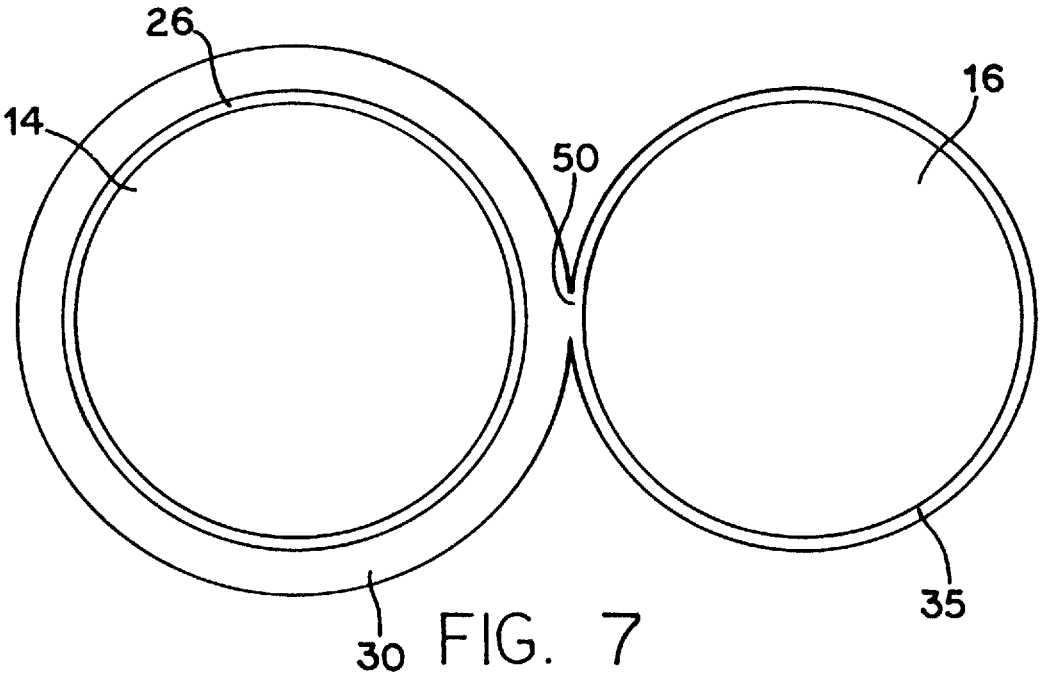
FIG. 7 is a plan view of one embodiment of the invented blister and lid, temporarily connected by a twist spot.
Figure 8:
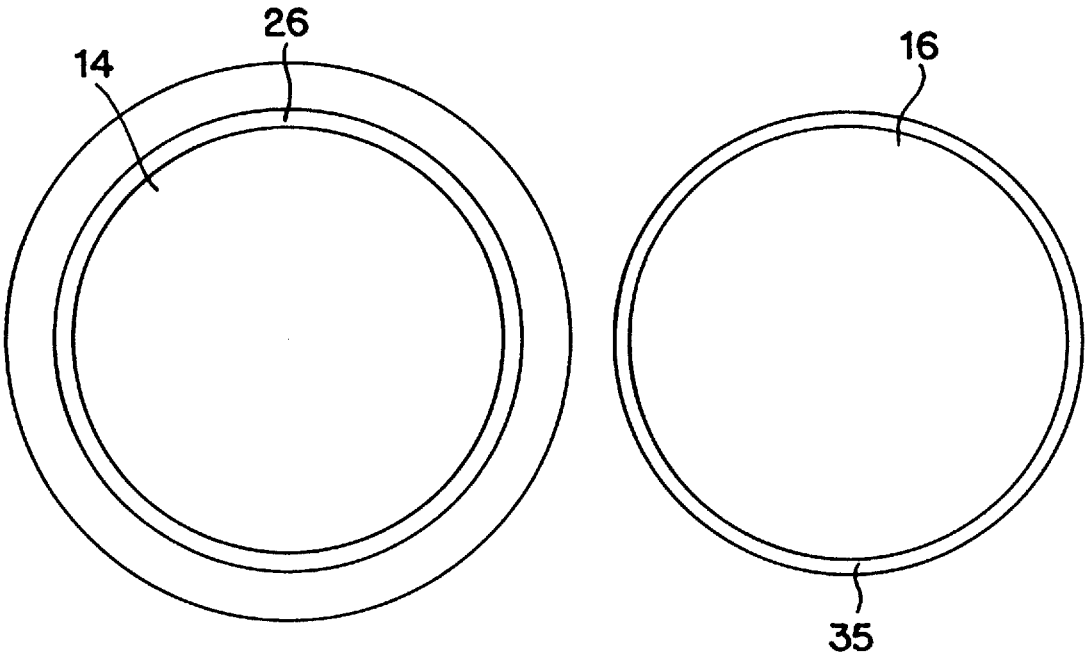
FIG. 8 is a plan view of an alternative set of blister and lid, separated and ready for assembly around a product or for use with automated machinery.

FIGS. 7 and 8 illustrate two methods of manufacturing and assembling the blister pack 11. The blisters and lids in FIGS. 7 and 8 may be sealed together in the same manner; the only difference is that the blister and lid of FIG. 7 are connected with a twist spot produced when the lid and blister are formed out of a single sheet of plastic. The twist spot 50 is twisted apart on a semi-automatic assembly line prior to assembly of the lid and blister. In FIG. 8, the blister and lid are two separate pieces designed to be assembled completely automatically. As illustrated by these two manufacturing approaches, the invented blister pack 11 need not include a hinge or pivoting connection between the blister and lid. The FIG. 7 and 8 embodiments are shown with a stepped sealing means as in FIG. 3, but the general approaches to manufacture that are shown in FIGS. 7 and 8 may adapted for the various styles of sealing means illustrated in FIGS. 4–6, for example.

Although this invention has been described above with reference to particular means, materials and embodiments, it is to be understood that the invention is not limited to these disclosed particulars, but extends instead to all equivalents within the scope of the following claims.

I claim:

1. A packaging system comprising:

a plastic blister defining an interior space for receiving a product, the blister having an opening into the interior space, and having a flange around the opening with a lower surface and having a stepped surface near the flange;

a plastic lid extending across the opening of the blister to enclose the product, the lid having an outer perimeter that is generally parallel to the blister flange and that has a lower surface, an upper surface and a generally vertical side surface, the outer perimeter upper surface and vertical side surface mating and sealing with the stepped surface of the blister;

a backing sheet larger than the opening of the blister and having a top surface; and sealing means extending continuously around substantially the entire lower surface of the blister flange and continuously around the lower surface of the outer perimeter of the lid for sealing the lid and blister lower surfaces to the top surface of the backing sheet;

wherein said stepped surface and said sealing means retain vapor and gasses inside the blister interior space.

2. The packaging system as in claim 1, wherein the sealing means for sealing the blister flange and the lid outer perimeter lower surfaces is thermal adhesive, and said thermal adhesive completely coats the backing sheet top surface.

3. The packaging system as in claim 1, wherein the backing sheet comprises a planar sheet of cardboard.

4. A packaging system comprising:

a plastic blister defining an interior space for receiving a product, the blister having an opening into the interior space, and having a flange around the opening with a lower surface and having a stepped surface near the flange;

a plastic lid extending across the opening of the blister to enclose the product, the lid having a central area and an outer flange generally parallel to the blister flange and having a lower surface, and the lid having a stepped surface near the lid outer flange mating and sealing with the stepped surface of the blister; and a backing sheet larger than the opening of the blister and having a top surface;

sealing means extending continuously around the entire lower surface of the blister flange and continuously along the lower surface of the lid flange for sealing the lid flange and blister flange to the top surface of the backing sheet; and wherein the central area of the lid is spaced from the top surface of the backing sheet;

wherein the stepped surfaces and the sealing means retain vapor and gasses inside the interior surface.

5. The packaging system as in claim 4, wherein the sealing means for sealing the blister flange and the lid flange to the backing sheet is adhesive.

6. The packaging system as in claim 4, wherein the stepped surface of the lid comprises one step with one step surface and one riser surface.

7. The packaging system as in claim 6, wherein the stepped surface of the blister comprises two generally horizontal step surfaces and one generally vertical riser surface.

8. The packaging system as in claim 6, wherein the stepped surface of the blister comprises two steps comprising two generally horizontal step surfaces and two generally vertical riser surfaces.

9. The packaging system as in claim 4, wherein the stepped surface of the blister comprises a plurality of steps, each step comprising a generally horizontal step surface and a generally vertical riser surface, and the blister stepped surface comprises a plurality of steps mating and sealing with the steps of the lid.

10. The packaging system of claim 4, wherein the lid is a single thermally-shaped sheet of plastic and the blister is single thermally-shaped sheet of plastic.

11. The packaging system of claim 4, wherein the backing sheet is a planar sheet of cardboard.

12. A packaging system consisting essentially of:

a plastic blister defining an interior space for receiving a product, the blister having an opening into the interior space, and having a flange around the opening with a lower surface and having a stepped surface near the flange;

a plastic lid extending across the opening of the blister to enclose the product, the lid having an outer perimeter that is generally parallel to the blister flange and that has a lower surface, an upper surface and a generally vertical side surface, the outer perimeter upper surface and vertical side surface mating and sealing with the stepped surface of the blister;

a backing sheet larger than the opening of the blister and having a top surface; and sealing means extending continuously around substantially the entire lower surface of the blister flange and continuously around the lower surface of the outer perimeter of the lid for sealing the lid and blister lower surfaces to the top surface of the backing sheet;

wherein said stepped surface and said sealing means retain vapor and gasses inside the blister interior space.

* * * * *